United States Patent [19]

Taniguchi

[11] 4,449,034

[45] May 15, 1984

[54] HEATING APPARATUS

[76] Inventor: Kazuyoshi Taniguchi, 126 Linda La., Green Creek, N.J. 08219

[21] Appl. No.: 316,722

[22] Filed: Oct. 30, 1981

Related U.S. Application Data

[63] Continuation-in-part of Ser. No. 74,924, Sep. 13, 1979, abandoned.

[51] Int. Cl.[3] ..... H05B 1/00

[52] U.S. Cl. ..... 219/217; 128/402; 219/218; 219/385; 219/527; 126/204; 126/209

[58] Field of Search ..... 219/211, 212, 217, 218, 219/214, 220, 527, 545, 385, 386, 474; 128/399, 402, 403; 126/204, 208, 209

[56] References Cited

U.S. PATENT DOCUMENTS

| | | | |
|---|---|---|---|
| 412,744 | 10/1889 | Green | 126/202 |
| 819,851 | 5/1906 | Chamberlain | 312/236 |
| 1,577,277 | 3/1926 | Wolfe | 128/399 X |
| 1,860,420 | 5/1932 | Johnson | 128/402 X |
| 1,979,094 | 10/1934 | Blunt | 219/217 X |
| 2,133,188 | 10/1938 | Conforti | 219/220 |
| 2,346,998 | 4/1944 | Reveno | 126/204 |
| 2,563,874 | 8/1951 | Salton | 219/218 |
| 2,662,966 | 12/1953 | Bruchhausen | 219/218 X |
| 2,734,990 | 2/1956 | Leuschner | 312/236 |
| 2,851,573 | 9/1954 | Muccilli | 219/217 |
| 2,858,547 | 11/1958 | Baumann | 219/217 X |
| 3,120,599 | 2/1964 | Hilgers | 219/474 |
| 3,220,424 | 11/1965 | Nelson | 128/402 X |
| 3,427,431 | 2/1969 | Costanzo | 219/212 |
| 3,438,069 | 4/1969 | Long | 219/217 X |
| 3,443,066 | 5/1969 | Weibel | 219/527 |
| 3,451,505 | 6/1969 | Hulin | 219/217 X |
| 3,474,725 | 10/1969 | McClaren | 219/385 X |
| 3,878,361 | 4/1975 | Levin et al. | 219/522 |
| 4,035,606 | 7/1977 | Browder | 219/211 |
| 4,107,509 | 8/1978 | Scher et al. | 219/211 |
| 4,210,073 | 7/1980 | Weiss | 219/385 X |

FOREIGN PATENT DOCUMENTS

| | | | |
|---|---|---|---|
| 820046 | 11/1951 | Fed. Rep. of Germany | 128/399 |
| 619173 | 3/1961 | Italy | 219/218 |
| 48-80882 | 10/1973 | Japan . | |
| 48-110261 | 12/1973 | Japan . | |
| 49-109875 | 9/1974 | Japan . | |
| 53-154388 | 11/1977 | Japan . | |
| 52-155676 | 11/1977 | Japan . | |
| 53-85369 | 7/1978 | Japan . | |
| 53-85370 | 7/1978 | Japan . | |
| 53-124181 | 10/1978 | Japan . | |
| 53-128284 | 10/1978 | Japan . | |
| 54-78277 | 6/1979 | Japan . | |
| 54-107574 | 7/1979 | Japan . | |
| 54-98714 | 7/1979 | Japan . | |
| 56-49838 | 5/1981 | Japan | 126/204 |
| 56-13554 | 10/1981 | Japan | 126/204 |
| 190665 | 5/1937 | Switzerland | 219/217 |
| 215621 | 10/1941 | Switzerland | 219/217 |
| 370552 | 8/1963 | Switzerland | 219/218 |
| 670278 | 4/1952 | United Kingdom | 219/218 |

*Primary Examiner*—Volodymyr Y. Mayewsky
*Attorney, Agent, or Firm*—Steele, Gould & Fried

[57] ABSTRACT

An apparatus for providing a warm environment within a cold environment, comprising a table having a surface member, heating means disposed beneath the surface member, an insulating layer disposed between the surface member and the heating means, and a skirt member secured to the surface member and depending therefrom, defining the warm environment, whereby persons sitting at the table are partially enveloped by the skirt and thereby kept comfortably warm, despite substantially cooler temperatures in the cold environment.

5 Claims, 7 Drawing Figures

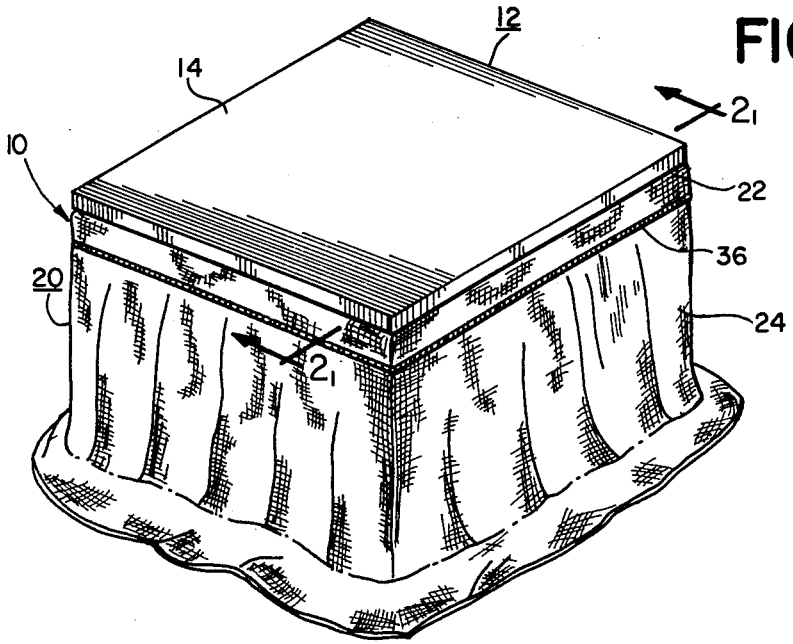
FIG. 1
FIG. 2
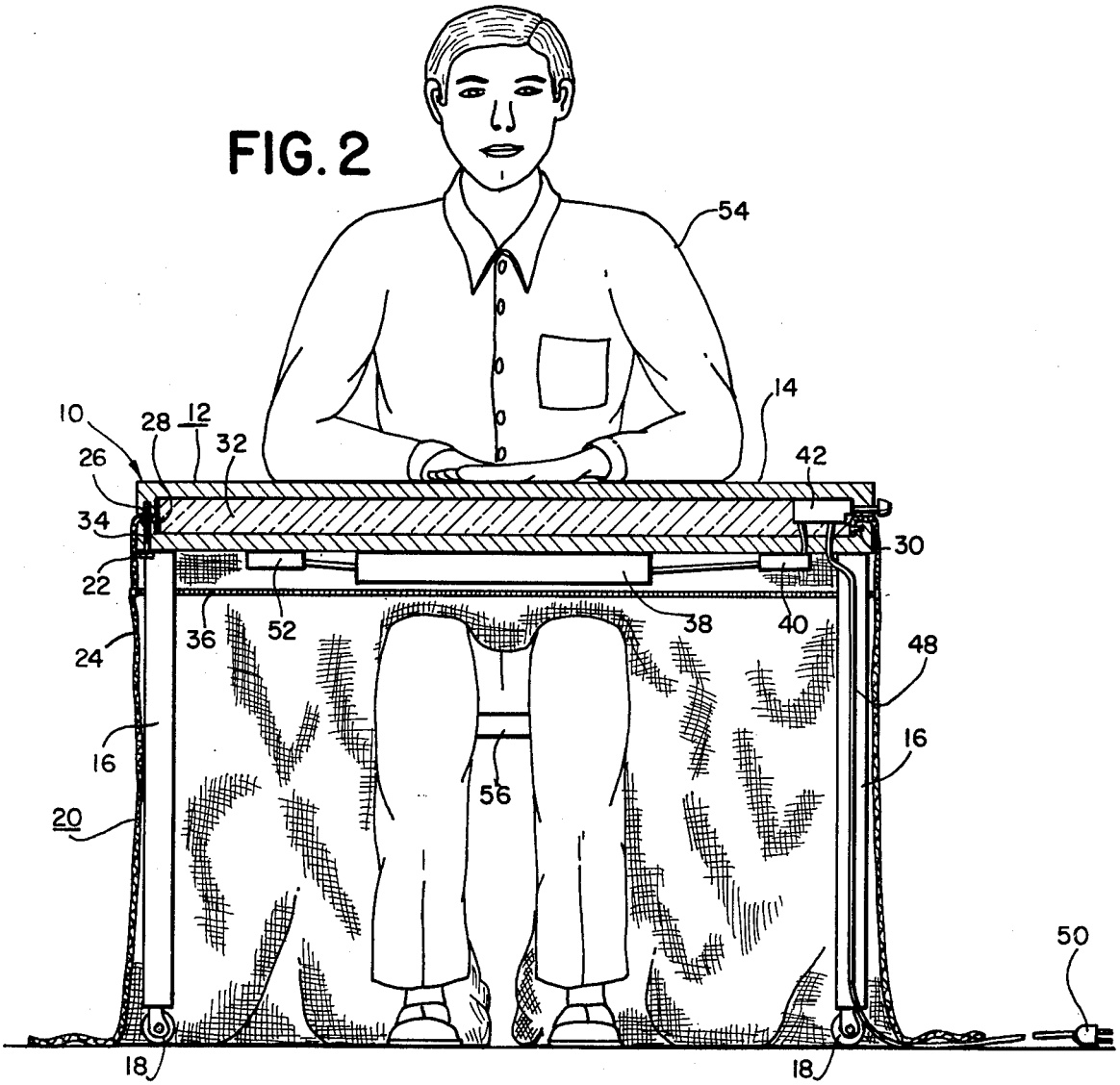

HEATING APPARATUS

CROSS-REFERENCE TO RELATED APPLICATIONS

This application is a continuation-in-part application of my co-pending application Ser. No. 074,924, filed Sept. 13, 1979, now abandoned.

BACKGROUND OF THE INVENTION

1. Field of the Invention

This invention relates generally to the field of energy saving heating apparatus, and in particular, to a heating apparatus having a working or playing surface, at which persons may be seated, and which provides a self-contained warm environment despite much colder ambient temperatures.

2. Prior Art

In the homes of traditional Japanese families, an apparatus has been known for a very long time which is utilized to provide maximum warmth in rooms otherwise chilled by cold weather, by concentrating the warmth at the center of activity within a room, in order that the entire room need not be heated. The apparatus referred to is known as a kotatsu. In traditional form, the kotatsu comprises a heavy board or gridlike support surface, itself supported by legs. A charcoal burning stove is placed under the table or suspended under the support surface, and a very large blanket is draped over the table completely covering the table and the open sides thereof. An additional surface member is placed over the blanket to provide a hard and durable surface for activities such as playing card games, writing and the like.

Persons wishing to take advantage of the kotatsu take a seat at the table-like structure, draping the blanket over their laps. Even when room temperatures are in the range of 50°-55° F., the warmth radiated to the lower portion of the body enveloped by the blanket is sufficient to keep the entire body comfortably warm. Further, it is believed that the cool air to which the head is subjected, and which is breathed, provides for greater alertness and clearer mental processes. The traditional kotatsu has several difficulties, including the dangers of carbon monoxide poisoning and fire. Despite these and other significant hazards, the kotatsu has remained popular in the form described for hundreds of years, and remains so to this day.

In modern times, attempts have been made to embody the traditional kotatsu in new and different ways to take advantage of improvements in technology. Electrically powered heaters have been used in place of traditional charcoal heaters, sometimes traditionally mounted under the kotatsu table and sometimes mounted in the supporting legs or in a pedestal supporting the table. Heated chairs have also been designed to complement the usual table.

In both the East and the West, apparatus for warming foods and the like have comprised tables having heaters adapted to maintain the temperature of a table top upon which food is placed. Of course, such apparatus is not effective to warm persons sitting around the table. Apart from Japanese custom, it has been suggested to incorporate an electric heater into the open area beneath a typical table as well as a combination fan and heater under a typical office desk. There is no provision in such devices for retaining any of the heat, and accordingly, the apparatus must run substantially continuously and inefficiently. Also known in the art are various forms of sleeping bags, sacks or the like, which are provided with powered heating elements. Such apparatus as are known in the art are not directed to providing substantially enclosed warm environments for as many as four persons or more, wherein only a portion of each person's body is disposed within the apparatus, and whereby normal social activities can be comfortably carried out without a great deal of obstruction.

The present invention goes beyond the traditional kotatsu as modified by the addition of electric heat. Care has been taken to provide an apparatus that is peculiarly adapted for Western lifestyles, yet secures the benefit of the traditional device. The present kotatsu is convenient, efficient and safe, providing a warm environment within a cold environment, the device comprising a table, having a surface member, heating means disposed beneath the surface member, an insulating layer disposed between the surface member and the heating means, and a skirt member detachably secured along the periphery of the surface member and depending therefrom, defining the warm environment, whereby persons sitting at the table are partially enveloped by the skirt and thereby kept comfortably warm despite substantially cooler temperatures in the cold environment.

SUMMARY OF THE INVENTION

It is an object of this invention to present an apparatus for providing a warm environment within a cold environment.

It is another object of this invention to provide an apparatus for providing a warm environment within a cold environment, and further providing a working or playing surface.

It is still another object of this invention to provide an apparatus for providing a warm environment within a cold environment, suitable for use by as many as four or more persons simultaneously.

It is yet another object of this invention to provide an apparatus for providing a warm environment within a cold environment, wherein only the lower portions of the body are heated, but nevertheless, great comfort is achieved.

It is yet another object of this invention to provide a warm environment within a cold environment, which functions with a minimal amount of energy as compared to that required to heat the ambient cold environment to comfortable levels.

It is yet another object of this invention to maximize safety, convenience and comfort in a furniture unit functioning as an activity center in a relatively cold environment.

These and other objects of this invention are accomplished by an apparatus for providing a warm environment within a cold environment, comprising a table having a surface member, defining a peripheral edge, heating means disposed beneath the surface member, an insulating member disposed between the surface member and the heating means, and a skirt member releasably secured at the peripheral edge and depending from the surface member, the skirt member defining the warm environment, whereby persons sitting at the table are partially enveloped by the skirt and thereby kept comfortably warm, despite substantially cooler temperatures in the cold environment. A central fixture comprising a lamp and heater control may be disposed at a vent in the surface member, a fan at the vent dispersing heat evenly within the warm environment. The heating means may comprise a radiant heating unit or an infra-red lamp heating unit, a thermostat for controlling the unit and high temperature responsive alarm means. As the skirt is removably attached, the table may be utilized merely as a table in warmer conditions. Even where room temperatures are, for example, as low as 50°-55° F., persons eating, working or playing at an apparatus according to this invention will be kept comfortably warm, and at the same time, the cooler ambient air will provide for clearer mental processes.

BRIEF DESCRIPTION OF THE DRAWINGS

For the purpose of illustrating the invention, there are shown in the drawings forms which are presently preferred, it being understood, however, that this invention is not limited to the precise arrangements and instrumentality shown.

FIG. 1 is a perspective view of a heating apparatus in accordance with this invention; and, FIG. 2 is a section view taken along the line 2—2 in FIG. 1 and further showing a person using the invention.

DETAILED DESCRIPTION OF THE PREFERRED EMBODIMENT

Figure 3:
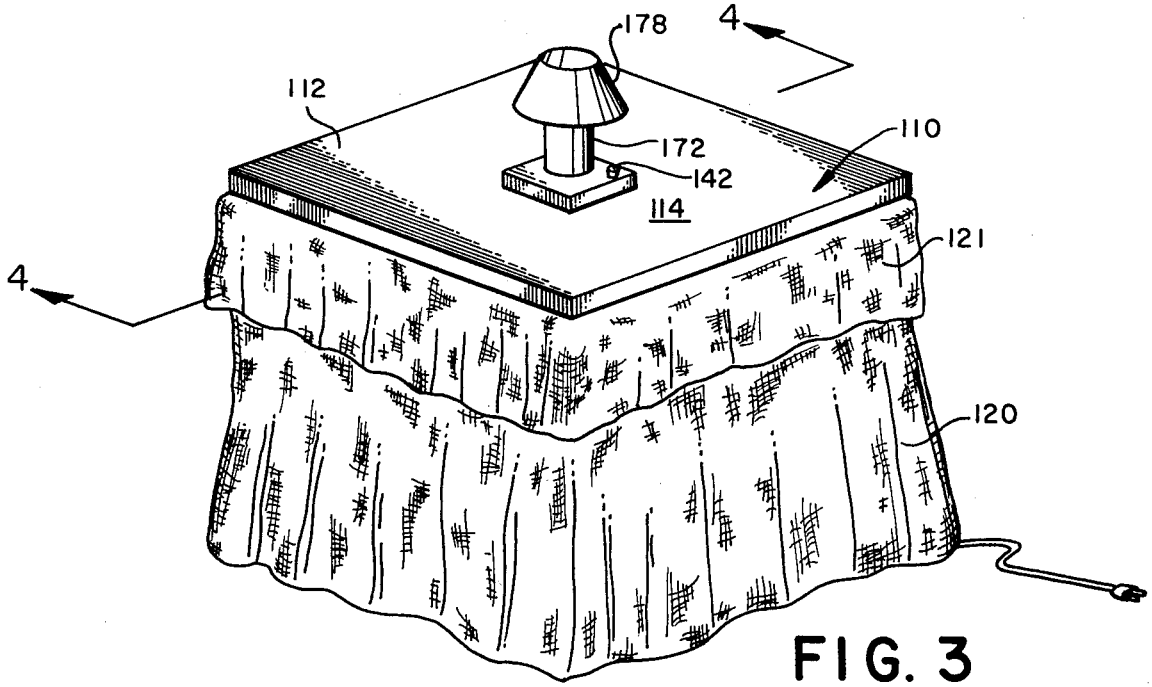
FIG. 3 is a perspective view of an alternative embodiment.

A heating apparatus 10 according to this invention is shown in FIG. 1. In the presently preferred embodiment, the heating apparatus 10 comprises a table 12, having an upper surface 14, and four legs or support members 16. The upper surface 14 comprises upper and lower members 15 and 17 respectively.

A skirt 20 is attached to the side of the table, completely surrounding the table. One edge 28 of the fabric may be slipped through slot 26 around the perimeter or edge of the table formed between upper and lower portions, and secured to the inside thereof by tacks or other fastening means 30. The skirt 20, which may be a drapery fabric or the like, may comprise two sections, an upper section 22 and a lower section 24. The upper section 22 is permanently secured to the table 12, as described. The lower section or portion 24 may be releasably attached to the upper portion 22, by means of a releasable securing means 36, such as a zipper or the like.

Mounted on the underside of upper surface 14 of table 12 are heating means 38, such as an infra-red lamp heating unit or a conventional 500 watt electrical radiant heating unit, a thermostat 40, for controlling the radiant heating means and a high temperature responsive alarm unit 52. The number of infra-red lamps or the power at the conventional radiant heater will vary in accordance with the size of the apparatus, the expected ambient temperature and other such factors. The thermostat is controlled by adjustment means 42, which passes through a hole in the side of table top 14. A power cord 48 for plug 50 may be conveniently attached to one of the leg or support members 16. Movement of the table may be facilitated by roller members 18. The upper and lower parts of surface member 14 may be connected by bolts or screws 34, or any other suitable attachment means. A layer of thermal insulating material 32 is disposed between upper and lower layers 15 and 17 of table top 14.

The apparatus is used as shown in FIG. 2. A person 54 may be seated on a chair 56, such that the lower portion of the body, from the lap or waist down, is underneath the table, that is, disposed within the boundaries of the skirt 20. The skirt 20 is arranged over the lap of the person so as to drape down along the sides of the chair and substantially seal the opening through which the lower portion of the body and the chair project. Accordingly, the skirt should be as full as possible, utilizing large pleats if necessary, and spreading out onto the floor. In the configuration of the table shown in the Figures, which is that of a standard card table, as many as four persons can comfortably sit, eat or play at the table simultaneously. Other geometrical configurations will provide for more or less persons utilizing the apparatus. It has been found that persons utilizing an apparatus as taught herein may be kept comfortably warm, even though the ambient temperature drop to as cold as 50°-55° F. It is further believed that as a result of the head remaining in the cooler air, and as a result of breathing the cooler air, one's mental processes are clearer.

Substantial energy savings can be achieved by use of the apparatus taught herein, inasmuch as it is now possible to set room or house thermostats as low as 50° F. or so, provided that persons in the room utilize the apparatus for eating, studying, playing games or whatever purposes they may desire. The energy required to operate the heating element of such an apparatus is very substantially less than that required to heat an entire room or an entire house. Such an apparatus is not limited to use within a home, and on cooler days, might even be used outdoors. In warmer seasons, a substantial portion of the skirt 20 may be removed by releasable attachment means 36, and the table may be used as such, without the heating capability activated. In the event that its use is needed, it will be ready for activation in only as much time as is necessary to reattach the skirt. It will be appreciated that all materials and fabrics used in the construction of this apparatus should be fire and flame retardent, if not entirely fire and flame proof.

In the traditional kotatsu, a single, continuous square or rectangular quilt was placed over the entire table, and covered with a rigid surface member, if desired. In the present invention, only so much fabric as is required to extend from the edge of the surface member to the floor is required. Of course, the fabric should be full or pleated, in order to accomodate the extra length required to encompass the user's legs and/or lower body. By so attaching the skirt to the edge of the table, there are advantages in that less material is required and the skirt member may be easily removed for cleaning or for air circulation during warm weather.

Figure 4:
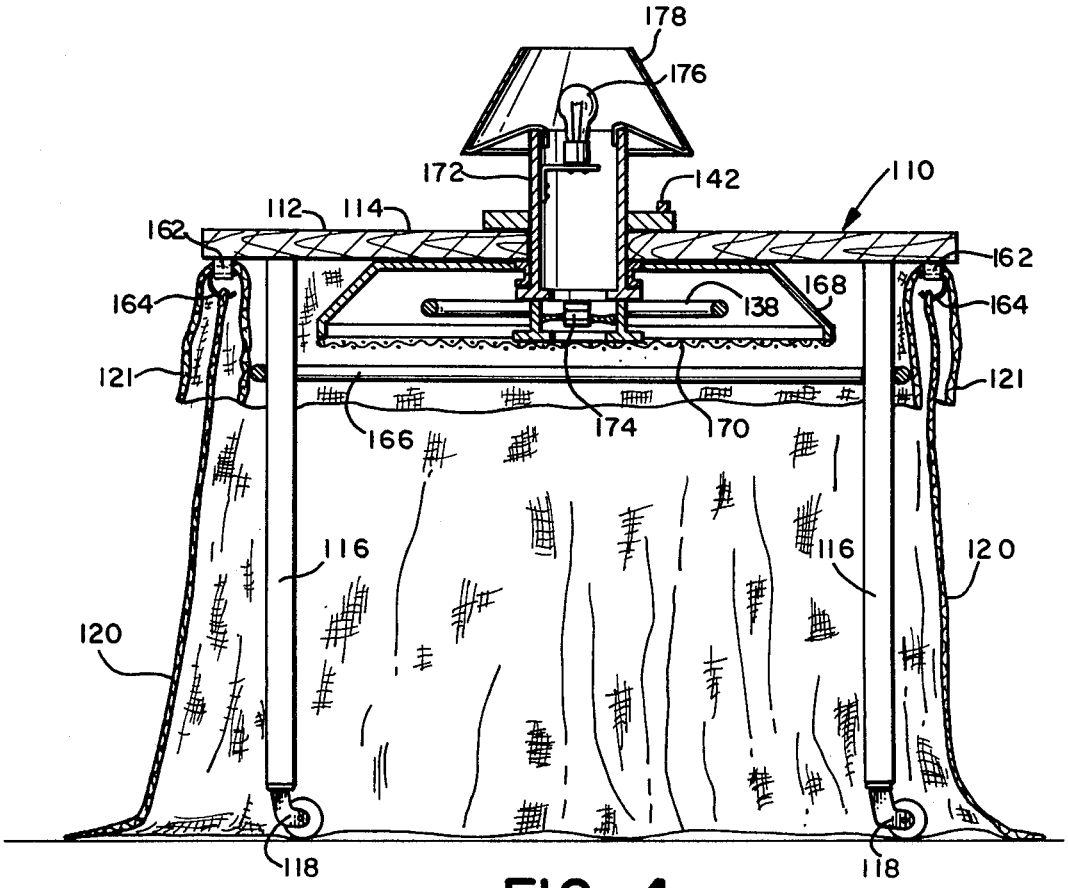
FIG. 4 is a section view taken along the line 4—4 in FIG. 3.

Alternative attachments of the skirt member to the table top are illustrated in FIGS. 3 through 7. In FIG. 4, upper tier 121 is suspended near its mid-point on rail 162, which rail also supports skirt member 120 by means of attachment hook 164. The attachment hook may be a curtain hook or other convenient means. It will be appreciated that in the embodiment of FIGS. 3 and 4, not only is skirt 120 removable, but upper tier 121 is removable as well.

Skirt sections 120, 121 are prevented from coming into contact with heating means 138 mounted under the table top by safety bar 166 which is attached at the outer surface of the legs slightly above the bottom of upper skirt 121. In this manner, upper skirt 121 cannot accidentally be carried on a user's knees into close proximity with heating means 138, thereby possibly causing a fire.

Figure 5:
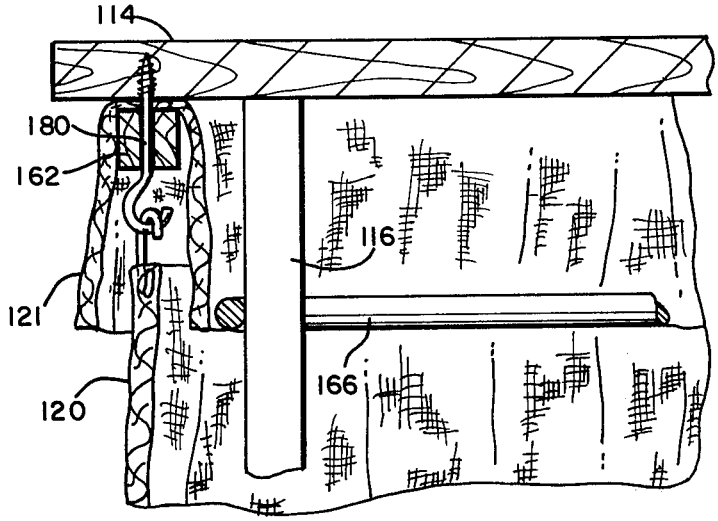
FIG. 5 is a partial section view illustrating an alternative attachment of the skirt.

The embodiment of FIG. 5 illustrates a relatively permanent attachment for upper tier 121. Rail 162, which supports the upper tier 121 and pinches it against tabletop 114 is attached to the table top by attachment means 180, for example, a threaded hook or eye. Lower skirt member 120 is then attached by means of a curtain rod or the like, to hook or eye 180. This arrangement is beneficial in that double layers of upper tier 121 prevent the escape of heat at or near the point of attachment.

Figure 6:
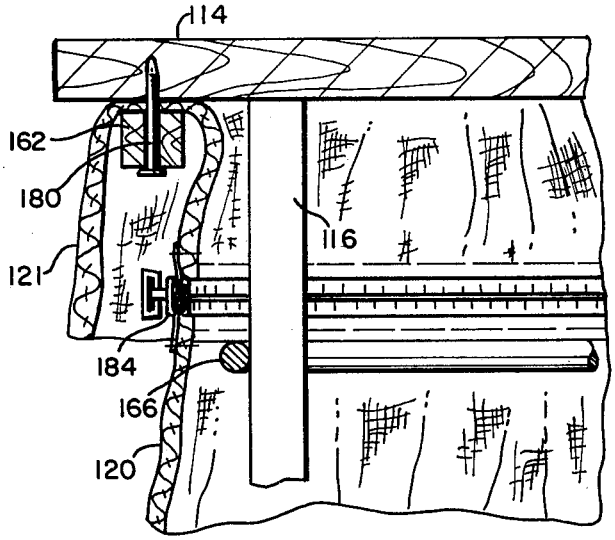
FIG. 6 is a partial section view illustrating an alternative attachment of the skirt.

FIG. 6 illustrates attachment of upper and lower skirt tiers 121, 120 by means of a zipper 184. In this embodiment, only the upper tier is attached to the table, the lower tier being attached to the upper tier along the internal hanging edge. Rail 162 pinches upper tier 121 against table top 114 by means of attachment 180, which may be a rail or screw. Nail or screw 180 may be driven directly through nail 162 and upper tier 121, or, to allow upper tier 121 to be easily removed, attachment means 180 may be provided only at the corners of the table, at which points upper tier 121 may be slotted. The embodiment of FIG. 6 also includes a safety bar 166, preventing a user's knees from carrying any part of the skirt into close proximity with the heating means mounted under the table top.

Figure 7:
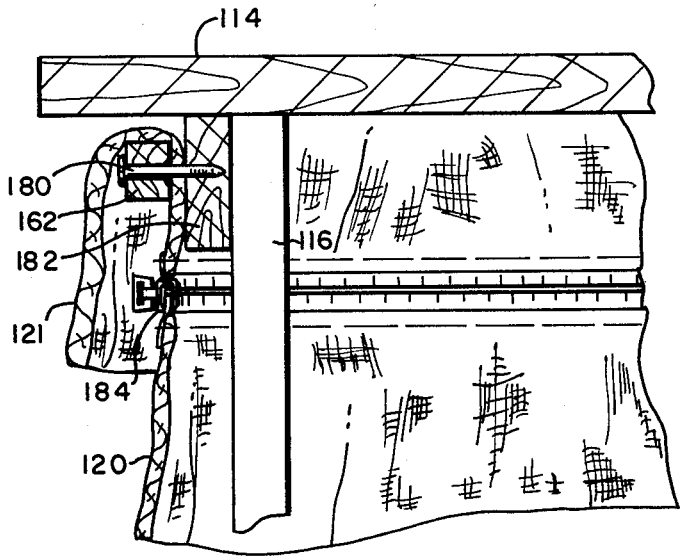
FIG. 7 is a partial section view illustrating an alternative attachment of the skirt.

In FIG. 7, the safety bar is replaced by structural support member 182, serving the same function as the safety bar. In addition, member 182 provides a mounting surface for rail 162 by means of attachment 180. The embodiment of FIG. 7 is somewhat more attractive during warm weather use, as the safety bar is less visible.

A preferred embodiment of the heating means is shown in FIG. 4. Heating element 138, which may be an electrical resistance coil, a heat lamp or the like, is mounted below a reflecting member 168 which directs radiant energy toward the floor and toward the users' feet and ankles. Protective screen 170, mounted to the downwardly extending edges of the reflector, safely encloses the heating means. Notwithstanding directing the radiant energy downwards, it will be appreciated that, warm air tending to rise, the temperature of the air under the table is likely to be much higher near the heating coil than near the floor. Accordingly, means are provided to circulate the air beneath the table, providing more even heat distribution.

In FIG. 4, fan 174 directs a stream of cooler input air through duct 172 towards the floor. Fan 174 therefore moderates the high temperatures expected near the table top by agitating and circulating the warm air throughout the area enclosed by skirt 120. A deflecting plate (not pictured) can be horizontally mounted directly in the path of the air stream, for example using stand-off bolts, at or near the level of the heating coil, whereby air is directed directly over the coil.

Fan 174 need not be mounted at the direct center of the table top, as shown in FIG. 4, but may also be mounted elsewhere under the table. In addition, duct 172 need not be included, whereby fan 174 functions merely to circulate the same air underneath table 114, rather than supplying cooler incoming air. Where cool air is brought in, as through duct 172, a positive pressure area is enclosed by skirt 120, minimizing any cold spots in the enclosure. Conversely, where no duct is employed, less heat is lost from the enclosure.

If a duct is employed to draw air into the enclosed area, an air filter is preferably included in the duct, for example, at the mounting between duct 172 and fan 174. If no filter is included, the apparatus will collect dust, particularly in the skirt material, necessitating more frequent cleaning. Excess dust also tends to collect around the heating element and screen, due to convection currents and the fan forcing air through a screen 170.

In the embodiment of FIG. 4, lamp 176 and shade 178 are conveniently mounted directly on duct 172, thereby providing a central air input that is both attractive, and a source of illumination for playing games and the like. The entire apparatus may be controlled from the same area, for example via switch 142. While only one switch 142 is shown, it will be appreciated that this switch can be a multiple contact switch having positions for different combinations of light, fan and heater. Alternatively, separate switches can be provided for each function. In addition, a power control such as a continuously-adjustable rheostat or a multi-position switch can be provided to set an appropriate power level for the heater, lamp and/or fan.

In a kotatsu used primarily as a card table, the central area of the table top is likely to be the most heavily used area. If such is the case, it is preferable to either forego the duct and mount fan 174 at a slight spacing from the lower surface of the table top, whereby air is drawn around the fan and directed downwards, or to provide a remote duct, for example a duct running under the lower edge of skirt 120 along the floor and to a fan forcing air into the enclosure.

For maximum safety, the apparatus should be equipped with means to prevent accidental overheating, such as might occur if misused or left heating for long periods. A timer can be incorporated to automatically disconnect power from the heater after a certain time, to prevent fire if the apparatus is inadvertently left on. A maximum temperature cutoff such as a bi-metal snap switch or a fusible link can be placed in the power line to disconnect power upon overheating. It is also helpful to incorporate a pilot lamp, or to use lamp 176 for that purpose, to clearly indicate when the unit is on.

The present invention may be embodied in other specific forms without departing from the spirit or essential attributes thereof, and accordingly, reference should be made to the appended claims, rather than to the foregoing specification as indicating the scope of the invention.

I claim:

1. An apparatus for providing a user a warm environment within a cold environment, comprising:

a table having a table top with a thermal insulating material disposed between an upper and lower surface of said table top, the table top supported by legs and having a peripheral edge, the table top and legs surrounding the legs of the user when seated at the table;

electric heating means disposed beneath the table top and attached thereto;

a metallic reflector disposed between the table top and the radiant heating means, the table top and the reflector each having an opening defining an air passage;

means for forcing air beneath table top, through the air passage; and, a flexible skirt member releasably secured around the peripheral edge and depending from the table top, the skirt member adapted to drape over the user's legs when inserted below the table top, the skirt confining heat to the user's legs, partially enveloped by the skirt and thereby kept comfortably warm, despite substantially cooler temperatures in the cold environment.

2. The apparatus of claim 1, where in the air passage is defined by an air passage extending through and above the table top and the air circulating means is a fan mounted in the air passage, directing air downwards.

3. The apparatus of claim 2, further comprising a lamp and a lampshade, said lamp and lampshade mounted on an upper end of said air passage.

4. The apparatus of claim 1, wherein the table member is provided with roller means.

5. The apparatus of claim 1, wherein the heating means comprises infra-red lamp heating unit.

* * * * *